US005700561A

United States Patent [19]

Mano et al.

[11] Patent Number: 5,700,561

[45] Date of Patent: Dec. 23, 1997

[54] CHROMATED METAL SHEET HAVING HIGH CORROSION RESISTANCE WITH IMPROVED LUBRICITY AND ELECTRIC CONDUCTIVITY

[75] Inventors: Junichi Mano; Youzou Ogawa, both of Tokyo; Masaki Mabuchi, Chiba; Keizou Okuno, Chiba; Nobuo Totsuka, Chiba, all of Japan

[73] Assignee: Kawasaki Steel Corporation, Japan

[21] Appl. No.: 558,346

[22] Filed: Nov. 16, 1995

Related U.S. Application Data

[63] Continuation of Ser. No. 183,514, Jan. 18, 1994, abandoned.

[30] Foreign Application Priority Data

Jul. 29, 1993 [JP] Japan ..... 5-187924

[51] Int. Cl.[6] ..... B32B 9/00

[52] U.S. Cl. ..... 428/327; 428/323; 428/622; 428/632; 428/666

[58] Field of Search ..... 428/629, 632, 428/666, 327, 621, 622, 624, 626, 699, 702, 323; 148/268

[56] References Cited

U.S. PATENT DOCUMENTS

| | | | |
|---|---|---|---|
| 2,809,127 | 10/1957 | Gibson et al. | 428/639 |
| 4,411,964 | 10/1983 | Hara et al. | 428/629 |
| 4,799,959 | 1/1989 | Fourez et al. | 428/629 |
| 4,804,587 | 2/1989 | Takeuchi et al. | 428/629 |
| 5,389,436 | 2/1995 | Totsuka et al. | 428/327 |

FOREIGN PATENT DOCUMENTS

| | | |
|---|---|---|
| 0 150 650 | 8/1985 | European Pat. Off. . |
| 54-161549 | 12/1979 | Japan . |
| 60-103185 | 6/1985 | Japan . |
| 61-227178 | 10/1986 | Japan . |
| 61-279687 | 12/1986 | Japan . |
| 63-83172 | 4/1988 | Japan . |
| 1-110140 | 4/1989 | Japan . |
| 2-034792 | 2/1990 | Japan . |
| 61227179 | 10/1996 | Japan . |
| 1 421 261 | 1/1976 | United Kingdom . |

*Primary Examiner*—David A. Simmons
*Assistant Examiner*—Linda L. Gray
*Attorney, Agent, or Firm*—Austin R. Miller

[57] ABSTRACT

The improved version of a chromated metal sheet has a chromate layer on at least one side of a metal substrate or a plated metal substrate and it is characterized in that the chromate layer has a chromium deposit of 10–200 mg/m$^2$ per surface in terms of metallic Cr, that the chromate layer contains silica in an amount of 0.1–6.0 in terms of the weight ratio of $SiO_2$ to Cr, and that the chromate layer contains at least one kind of lubricating particles selected from the group consisting of graphite, $MoS_2$, BN, calcium stearate and an organic lubricating substance in an amount of 0.1–100 in terms of the weight ratio of the lubricating particles to Cr. The lubricating particles can have a surface layer capable of nonionic surface activating action, and this surface layer accounts for 1–70 wt % of the lubricating particles. The chromated metal sheet has sufficient lubricity to withstand press forming in the absence of lube oil coatings, has high enough electric conductivity to present no problems in spot weldability and groundability, and has sufficiently high corrosion resistance to withstand use in a naked state.

16 Claims, No Drawings

CHROMATED METAL SHEET HAVING HIGH CORROSION RESISTANCE WITH IMPROVED LUBRICITY AND ELECTRIC CONDUCTIVITY

This application is a continuation of now abandoned application Ser. No. 08/183,514, filed Jan. 18, 1994.

BACKGROUND OF THE INVENTION

This invention relates to chromated metal sheets that are suitable for use in a naked state as parts of home electric appliances, such as the chassis of audio or video equipment.

Conventional galvanized steel sheets are generally chromated with a view to protecting them against rusting. However, in the early stage of their development, the quality level of galvanized steel sheets was such that they merely satisfy the requirement for temporary rust prevention in the period from the delivery by the sheet producer to the use by manufacturers of home electric appliances (for example, the sheets generate rust in 24–48 hours by the salt spray test under JIS Z 2371). Therefore, to use such galvanized steel sheets in practice, they are generally coated with rust preventing paints after being worked to shapes and they have been unable to withstand use in a naked state without the coating of rust preventing paints.

Under the circumstances with a view to producing chromate films that could be used in a naked state, various techniques have been developed, as exemplified by the incorporation of additives such as colloidal silica in the chromate film, or forming an organic resin base film over the chromate film. Thus, the use of chromate films in a naked state without paint coatings has recently become a common practice.

In the process of producing home electric appliances, office automation equipment, automotive parts, etc., there are many situations where it is necessary to press form various metal sheets including steel sheets, Zn or Zn base alloy plated steel sheets, and Al or Al alloy sheets.

In most cases, such metal sheets are press formed with a lube oil being coated thereon but this practice has suffered from the following problems:

(1) since the lube oil is in many cases applied by spraying, it scatters around to deteriorate the working environment; and (2) the lube oil has to be removed after press forming and either a solvent (Freon®, 1,1,1-trichloroethane, etc.) or an alkali cleaner is used in this degreasing step but this makes it necessary to apply antipollution procedures, which not only leads to a higher cost but also deteriorates the working environment.

Thus, with a view to preserving a clean environment by eliminating the degreasing step, a growing demand has arisen to develop metal sheets that can press form to predetermined shapes without application of lube oils and which can subsequently be used without adopting the degreasing step. Heretofore, various proposals have been made as regards the composite coated steel sheets in which the chromate film is coated with an organic resin that contains a solid lubricant. Typical examples of such proposals are described below.

Japanese Patent Application (kokai) No. Sho 60-103185 discloses a double-layered steel sheet that usually has a chromate layer as the first layer, with the second layer being composed of a urethane-modified epoxy resin layer containing composite aluminum phosphate, chromic acid, rust preventing pigment, polyolefin wax, $MoS_2$, silicone resin, etc.

Japanese Patent Application (kokai) No. Sho 61-227178 discloses a surface treated steel sheet that has a chromate layer as the first layer and in which the second layer is composed of an acrylic resin layer containing a solid lubricant.

Japanese Patent Application (kokai) No. Sho 61-227179 discloses a surface treated steel sheet that has a chromate layer as the first layer and in which the second layer is composed of an acrylic resin layer having contained therein a chromate, silica sol, a mixture of a solid lubricant and a lube oil, a silane and/or titanate coupling agent, and a colored pigment.

Japanese Patent Application (kokai) No. Hei 1-110140 discloses a composite coated steel sheet that has a chromate layer as the first layer and in which the second layer is composed of an acrylic resin layer containing 5–40 wt % of colloidal silica, a solid lubricant that is surface treated with a titanate coupling agent, and an epoxy resin.

However, these related techniques have had a serious defect in that the resin layers formed over the metal substrates deteriorate their inherent electric conductivity.

With a view to improving the electric conductivity, Japanese Patent Application (kokai) No. Sho 63-83172 proposed the technique of incorporating conductive particles in the resin layer. However, with the recent advances in information processing equipment, the requirements for the conductivity and groundability of metal surfaces have become stringent to such a level that they can no longer be satisfied by those related techniques.

The chassis of computers and other parts of equipment that must be shielded from electromagnetic waves are required to have conductivity equivalent to surface electric resistivities of no more than 1Ω in order to prevent such troubles as the leakage of high-frequency electromagnetic waves or noise generation due to electromagnetic induction.

The major drawback of the related techniques described above originates from the fact that the resin layer is formed uniformly over the chromate layer with a view to improving its workability. Resins usually have very high volume resistivities on the order of $10^{15}\Omega\cdot cm$ and even if they are applied as very thin films of about 1 μm, they are present on the surfaces of metal sheets as layers having an interlayer resistance of at least $10^{10}\Omega$ and this has been a factor that deteriorates the conductivity and groundability of the final product.

Further, the attempt to provide better conductivity by adding conductive particles to the resin layers has suffered from the following major problems: first, in order to achieve sufficient conductivity to satisfy the requirement levels in recent years, a large amount of conductive particles must be added but then the operational efficiency of resin application and the characteristics of the resin to be applied are deteriorated; second, the contact between conductive particles and the metal substrate causes so-called "galvanic corrosion" (corrosion due to contact of different metals), thereby deteriorating the corrosion resistance of the metal.

SUMMARY OF THE INVENTION

The present invention has been accomplished under these circumstances and has as an object providing a chromated metal sheet that has sufficient lubricity to withstand press forming in the absence of lube oil coatings, that has high enough electric conductivity to present no problems in spot weldability and groundability, and which has sufficiently high corrosion resistance to withstand use in a naked state.

According to the first aspect of the present invention, there is provided a chromated metal sheet having high corrosion resistance with improved lubricity and electric conductivity. The sheet of the first aspect of the present invention has a chromate layer on at least one surface of a metal substrate or a plated metal substrate and it is characterized in that the chromate layer has a chromium deposit of 10–200 mg/m$^2$ per surface in terms of metallic Cr, that the chromate layer contains silica in an amount of 0.1–6.0 in terms of the weight ratio of $SiO_2$ to Cr, and that the chromate layer contains at least one member of lubricating particles selected from the group consisting of graphite, $MoS_2$, BN, calcium stearate and an organic lubricating substance in an amount of 0.1–100 in terms of the weight ratio of the lubricating particles to Cr.

According to the second aspect of the present invention, there is provided in a chromated metal sheet that has high corrosion resistance with improved lubricity and electric conductivity and that has a chromate layer on at least one surface of a metal substrate or a plated metal substrate, the improvement wherein the chromate layer has a chromium deposit of 10–200 mg/m$^2$ per surface in terms of metallic Cr and wherein the chromate layer contains silica in an amount of 0.1–6.0 in terms of the weight ratio of $SiO_2$ to Cr, as well as lubricity imparted particles each of which has a surface layer capable of nonionic surface activating action on at least one lubricating particle selected from the group consisting of graphite, $MoS_2$, BN, calcium stearate and an organic lubricating substance, the lubricity imparted particles in terms of the lubricating particles being present in an amount of 0.1–100 in terms of the weight ratio of the lubricating particles to Cr, 1%–70% by weight of said lubricity imparted particle being comprised of the surface layer capable of nonionic surface activating action.

In a preferred embodiment, the organic lubricating substance is at least one member of lubricating particles selected from the group consisting of natural waxes, polyolefin waxes, modified polyolefin waxes and fluorocarbons.

In yet another preferred embodiment, said chromate layer is such that the chromium contained therein is chiefly composed of trivalent Cr and the Cr that is insoluble in an aqueous alkaline solution is contained in an amount of at least 70 wt % of the total Cr content. It is also preferred that the coverage of the surface of the metal substrate with said lubricating particles or said lubricity imparted particles is no more than 50%.

In a further embodiment, the metal substrate or the plated metal substrate is advantageously selected from among steel sheets, electro-galvanized steel sheets, hot-dip galvanized steel sheets, aluminum or aluminum alloy plated steel sheets, aluminum sheets, and aluminum alloy sheets.

DETAILED DESCRIPTION OF THE INVENTION

The present invention is described below in detail.

The chromated metal sheet of the first aspect of the present invention has a chromate layer on at least one surface of a metal substrate or a plated metal substrate and it has high corrosion resistance with improved lubricity and electric conductivity. The chromate layer in this chromated metal sheet has a chromium deposit of 10–200 mg/m$^2$ per surface in terms of metallic Cr; this chromate layer contains silica in an amount of 0.1–6.0 in terms of the weight ratio of $SiO_2$ to Cr; the chromate layer further contains one or more kinds of lubricating particles selected from the group consisting of graphite, $MoS_2$, BN, calcium stearate and an organic lubricating substance in an amount of 0.1–100 in terms of the weight ratio of the lubricating particles to Cr.

The chromated metal sheet of the second aspect of the present invention has a chromate layer on at least one surface of a metal substrate or a plated metal substrate, in which the chromate layer has a chromium deposit of 10–200 mg/m$^2$ per surface in terms of metallic Cr and furthermore the chromate layer contains silica in an amount of 0.1–6.0 in terms of the weight ratio of $SiO_2$ to Cr, as well as lubricity imparted particles each of which has a surface layer capable of nonionic surface activating action on at least one lubricating particle selected from the group consisting of graphite, $MoS_2$, BN, calcium stearate and an organic lubricating substance, the lubricity imparted particles in terms of the lubricating particles being present in an amount of 0.1–100 in terms of the weight ratio of the lubricating particles to Cr, 1%–70% by weight of said lubricity imparted particle being comprised of the surface layer capable of nonionic surface activating action.

The metal substrate or plated metal substrate which are to be chromated in the present invention are selected from among steel sheets, electro-galvanized steel sheets, hot-dip galvanized steel sheets, aluminum or aluminum alloy plated steel sheets, aluminum sheets, aluminum alloy sheets, etc.

In the present invention, these metal substrates or metal plated substrates are coated with a chromating solution containing silica and lubricating particles or lubricity imparted particles by means of an applicator such as a bar coater or a roll coater and are then dried at about 80°–300° C. to form a chromate layer, thereby insuring corrosion resistance, conductivity and any other necessary properties.

Thus, in the present invention, no organic resins that are deleterious to conductivity are applied to the substrates and this insures that satisfactory conductivity is readily imparted with silica and lubricating particles or lubricity imparted particles if they are used in the appropriate ranges. Therefore, the chromated metal sheet of the present invention is also applicable to sites where not only good spot weldability but also effective grounding is required.

If the chromate layer formed in the present invention has a chromium deposit of less than 10 mg/m$^2$ per surface in terms of metallic Cr, one cannot expect high corrosion-resisting performance in the press formed sheet. On the other hand, if the Cr deposit exceeds 200 mg/m$^2$ per surface in terms of metallic Cr, the thickness of the chromate layer becomes so great that the chance of separating off of the film from the substrate during press forming will increase and mold galling becomes more likely to occur. For these reasons, the chromium deposit is specified to lie within the range 10–200 mg/m$^2$ per surface in terms of metallic Cr.

If the chromium that is alkali insoluble is contained in the chromate layer in an amount less than 70 wt % of the total Cr content, chromium may dissolve out during painting and other steps to cause a problem. Therefore, the chromium that is insoluble in an aqueous alkali solution is preferably contained in an amount of at least 70 wt % of the total Cr content.

In the present invention, chromating is desirably performed on both surfaces of the metal substrate but, if this is not practical, only one surface of the substrate may be chromated.

The chromating solution to be used in the present invention contains chromic anhydride, bichromic acid, chromates, etc. as the source of chromium, and silica and lubricating particles are added in association with the Cr source. The chromating solution may be an aqueous solution of partially reduced chromic acid. The chromating solution may contain other components such as phosphoric acid.

Silica is added primarily for the purpose of insuring corrosion resistance. If it is added in an amount less than 0.1 in terms of the weight ratio of $SiO_2$ to Cr, the necessary corrosion resistance is not attained. If the weight ratio of $SiO_2$ to Cr exceeds 6.0, there is a potential for conductivity to be impaired. Hence, the weight ratio of $SiO_2$ to Cr is specified to lie within the range from 0.1 to 6.0.

The silica to be used in the present invention may be either aqueous silica (colloidal silica or water-dispersing silica) or the vapor-phase silica which is derived by vapor-phase thermal decomposition of organosilicic compound and their particle size is desirably not more than 100 μm.

The lubricating particles are added in order to insure the lubricity of the metal sheet. The lubricating particles are of at least one kind that is selected from among graphite, $MoS_2$, BN, calcium stearate and an organic lubricating substance; if desired, two or more kinds of lubricating particles may be used in admixture. If the average size of the lubricating particles exceeds 20 μm, the chance of those particles of shedding off the chromate film increases and during subsequent working, those particles will build up on the inner surfaces of the mold and its galling is highly likely to occur in the presence of such deposited particles or flakes of the chromate film. Hence, the lubricating particles are preferably fine grains having an average particle size of no more than 20 μm. The term "average particle size" as used herein means a Stokes average diameter measured by an optical method.

The organic lubricating substance may be one or more kinds of lubricating particles that are selected from among natural waxes, polyolefin waxes, modified polyolefin waxes and fluorocarbons.

As the lubricating particles used in the present invention, polyolefin waxes (including polyethylene wax), oxidated polyolefin waxes (including oxidated polyethylene wax), halogen or acid modified polyolefin waxes (including modified polyethylene wax), and fluorocarbons such as polytetrafluorocarbon are more preferably used with a view to press forming property.

The lubricating particles are in no way effective in providing improved lubricity if they are added in amounts less than 0.1 in terms of the weight ratio of the lubricating particles to Cr. If their addition exceeds 100, the adhesion of the chromate film deteriorates and mold galling can occur during subsequent pressing. Therefore, the amount of addition of the lubricating particles is limited to the range from 0.1 to 100 in terms of the weight ratio of the lubricating particles to Cr.

The long-term stability of the chromating solution is also an important engineering factor in the production of chromated metal sheets. If the same solution is to be used for a long period, in place of the lubricating particles, the lubricity imparted particles each of which has a surface layer capable of nonionic surface activating action on the lubricating particle are preferably used.

Lubricating particles can be dispersed in aqueous solution by utilizing either the electric repulsion among charged particles or the nonionic steric hindrance effect. However, the chromating solution has generally a high electrolyte concentration and if it is treated by the first mentioned method of utilizing the force of electric repulsion, repelling particles will tend to attract ions toward the neutralization of surface charges and the force of repulsion among them decreases, eventually causing the particles to agglomerate. The agglomerating particles will separate out by either precipitation or floating on the surface of the chromating solution, causing gradual loss in the lubricity imparting function of the chromating solution containing the lubricating particles.

In view of this fact, a layer having nonionic surface activating action is desirably formed on the outer surface of each of the lubricating particles. In the present invention, particles each of which comprises the lubricating particle and the layer having nonionic surface activating action formed on the lubricating particle such as graphite, $MoS_2$, BN, calcium stearate, organic lubricating substance, etc. are referred to as the lubricity imparted particles. The nonionic surface activating layer can be formed by causing nonionic surfactants or water-soluble polymers to be adsorbed on the surfaces of the lubricating particles.

Exemplary nonionic surfactants include: alkylphenol type surfactants represented by $R—C_6H_4—O—(CH_2CH_2O)_nH$ (n=2–50; R is an alkyl group having a straight chain or a simple side chain ($C_xH_{2x+1}$, X=1–20)); preferably, $R=C_9H_{19}$ or $C_8H_{17}$; a higher alcohol type surfactants represented by $RO(R'O)_n(R''O)_mH$ (HLB value=7–16; R is an alkyl group having a straight chain or a simple side chain, R' and R" are an alkylene group having a straight chain or a simple side chain ($C_xH_{2x}$, x=1–20); n=1–30, m=1–30); and polyalkylene glycol type surfactants represented by $RO(EO/PO)_nH$ (R is an alkyl group having a straight chain or a simple side chain; $E=CH_2CH_2$; $P=CH_2CH_2CH_2$; n=1–50). Exemplary water-soluble polymers include polyethylene glycol and polyvinyl alcohol.

If the nonionic surface layer accounts for less than 1% by weight of the lubricity imparted particle, its ability to disperse the particles is so small that the latter will agglomerate and precipitate in the chromating solution. If less than 30% by weight of the lubricity-imparted particle is comprised of the lubricating component (that is lubricating particle), they will make only a small contribution in lubricity. Therefore, it is desired that from 30% to no more than 99% by weight of the lubricity imparted particle is occupied by the internal lubricating substance (that is lubricating particle) while, at the same time, from 1% to less than 70% by weight of the lubricity imparted particle is occupied by the surface layer having nonionic surface activating action.

The reasons already set forth above will apply to the case where the lubricity imparted particles each of which has the surface layer with nonionic surface activating action are to be used in place of the lubricating particles, and those lubricity imparted particles are preferably added in amounts of 0.1–100 in terms of the weight ratio of the lubricity imparted particles as calculated in terms of the lubricating particles to Cr, and the lubricity imparted particles have preferably an average particle size of no more than 20 μm.

The coverage of the surface of the metal sheet with the lubricating particles or lubricity imparted particles is preferably no more than 50%. If the coverage exceeds 50%, problems may arise in such aspects as electric conductivity.

EXAMPLES

The following examples are provided for the purpose of further illustrating the present invention but are in no way to be taken as limiting.

Three types of specimens were used: cold rolled steel sheets (SPCC) with a thickness of 1 mm; electrogalvanized steel sheets (SECC) with a Zn deposit of 20 g/m$^2$ on each surface; and hot-dip galvanized steel sheets (SGCC) with a Zn deposit of 60 g/m$^2$ on each surface.

The chromating solution was prepared from chromic anhydride with liquid-phase silica of an average particle size of 14 nm ("Snowtex O", the trade name of Nissan Chemical Industries, Ltd.) or vapor-phase silica of an average particle size of 7 nm (Nippon Aerosil Co., Ltd.) being added in an appropriate amount. The chromating solution was subjected to a suitable degree of preliminary reduction by treatment with a reducing agent. The chromium that was insoluble in aqueous alkali solution was present in an amount of 85–95% by weight of the total Cr content.

The types of lubricating particles that were used are identified in Tables 1 and 2 by symbols A–F, which have the following meanings:

A, graphite;

B, $MoS_2$;

C, BN;

D, calcium stearate;

E, polyethylene wax;

F, PTFE (polytetrafluoroethylene wax).

The types of nonionic surfactants that were used are identified in Table 2 by symbols W, X and Y, which have the following meanings:

W, "Liponox NC-100", the trade name of Lion Corp. for an alkylphenol type nonionic surfactant;

X, "Leocol SC-90", the trade name of Lion Corp. for a higher alcohol type nonionic surfactant;

Y, "PEG 1500", the trade name of Sanyo Chemical Industries, Ltd. for polyethylene glycol.

However, it should be noted that these are not the sole examples of nonionic surfactants that can be used in the present invention.

The types of anionic and cationic surfactants that were used are identified in Table 2 by symbols V and Z, which have the following meanings:

V, sodium salt of lauryl sulfate (anionic); and

Z, stearyl dimethylbenzyl ammonium chloride (cationic).

The following two types of waxes were used as wax emulsions having a nonionic surface layer:

a. "KUE-13", the trade name of Sanyo Chemical Industries, Ltd. natural wax, 29% solids wax;

b. "KUE-8", the trade name of Sanyo Chemical Industries, Ltd., modified polyethylene wax, 86% solids wax.

The following type of wax was used as a wax emulsion having an anionic surface layer:

c. "EMUSTAR-0001", the trade name of Nippon Seiro Co., Ltd. for synthetic wax.

To prepare lubricity imparted particles by adsorbing surfactants on the lubricating particles such as the aforementioned $MoS_2$, BN and polyolefin wax, the following method was adopted: first, aqueous solutions of the surfactants were prepared and, after addition of the lubricating particles, the solutions were ripened under stirring. Subsequently, the solutions were mixed with the chromating solution to give the necessary concentrations.

Lubricating particles A–F were treated in a ball mill to adjust their size to the value indicated in Tables 1 and 2.

Immediately after mixing with the lubricating particles or lubricity imparted particles, the prepared chromating solution applied to the three types of steel sheets (SPCC, SECC and SGCC) with a bar coater and dried at 150° C. The characteristics of the as-formed chromate films are shown in Table 1.

In another run, the prepared chromating solution was stored with stirring for one week and thereafter applied to the steel sheets or the aluminum alloy sheets with a bar coater, followed by drying at 150° C. The characteristics of the thus formed chromate films are shown in Table 2. These chromate films had a Cr deposit of 50 mg/m$^2$ per surface in terms of metallic Cr and the weight ratio of $SiO_2$/Cr was 3.0.

(Press formability)

Evaluation of press formability was conducted on the basis of the following criteria.

In the case of steel sheets and plated steel sheets, a check was made as to whether blanks having a diameter of 73 mm could be successfully drawn out in a cylinder (33 mmϕ) draw test without application of a lube oil and as to how much powdering occurred.

X; Could not be drawn out;

Δ; Could be drawn out but the amount of powdering on the side wall was more than 0.5 g/m$^2$;

○; Could be drawn out but the amount of powdering on the side wall was more than 0.1 g/m$^2$ but not more than 0.5 g/m$^2$;

⊙; Could be drawn out and the amount of powdering on the side wall was no more than 0.1 g/m$^2$.

In the case of aluminum sheets and aluminum alloy sheets a, check was made as to whether blanks having a diameter of 66 mm could successfully be drawn out in a cylinder (33 mmϕ) draw test without application of a lube oil and as to how much powdering occurred.

X; Could not be drawn out;

Δ; Could be drawn out but the amount of powdering on the side wall was more than 0.5 g/m$^2$;

○; Could be drawn out but the amount of powdering on the side wall was more than 0.1 g/m$^2$ but not more than 0.5 g/m$^2$;

⊙; Could be drawn out and the amount of powdering on the side wall was no more than 0.1 g/m$^2$.

(Electric conductivity)

For conductivity evaluation, surface resistivity measurements were conducted with a LORESTA MCP-tester, the trade name of a surface resistivity meter produced by Mitsubishi Petrochemical Co., Ltd. Ten measurements were conducted and the average was taken for use as an evaluation index.

⊙; less than 0.1Ω;

○; 0.1Ω or more but less than 0.5Ω;

Δ; 0.5Ω or more but less than 2Ω;

X; 2Ω or more (Corrosion resistance)

To check corrosion resistance, the samples were subjected to a salt spray test (JIS Z 2371); those which suffered from 5% rusting in less than 100 h were rated X and those which suffered from 5% rusting only after 100 h were rated ○.

(Proportions of lubricating components)

The proportions of lubricating components in the lubricity imparted particles were determined in terms of the weight proportion of the added lubricating particles in the solids content as measured after adsorption of the surfactants.

To determine the coverage of the surface of metal sheet with the lubricating particles or lubricity imparted particles, surface examination was made (×1000) by SEM and the average was taken of randomly selected 20 visual fields.

The results of the various evaluations conducted are shown in Tables 1 and 2.

As one can see from those tables, the samples prepared in accordance with the present invention all exhibited satisfactory press formability (lubricity), electric conductivity and corrosion resistance.

In contrast, according to Table 1 which shows the results of applying the chromating solution just after bath preparation, sample Nos. 1 and 28 did not exhibit satisfactory corrosion or workability due to insufficient chromate deposit, whereas sample Nos. 2 and 29, having excessive chromate deposits, had the chromate layer broken during working, indicating poor workability and, at the same time, their electric conductivity was poor.

Sample Nos. 3 and 20 did not exhibit satisfactory corrosion resistance due to insufficient silica addition.

Sample Nos. 4 and 21 did not have satisfactory electric conductivity due to excessive silica content.

Sample Nos. 5 and 22 did not satisfactory press formability due to insufficient addition of the lubricating particles.

Sample Nos. 6 and 23 were poor in electric conductivity due to the excessive presence of the lubricating particles.

When the chromating solution was stored for 7 days (according to Table 2 which shows the results of applying the chromating solution 7 days after bath preparation), sample Nos. 34 and 56 which did not use surfactants were unable to prevent the lubricating particles from agglomeration and, as a result, those particles would not enter the chromate film, thus leading to poor workability.

Sample Nos. 35 and 57 contained insufficient amounts of nonionic surfactants to prevent the lubricity imparted particles from agglomerating and, as a result, those particles would not enter the chromate film, thus leading to poor workability.

Sample Nos. 36, 37, 38, 48 and 58 which used ionic surface layers could not prevent the lubricity imparted particles from agglomerating and, as a result, those particles would not enter the chromate film, thus leading to poor workability.

Sample Nos. 39, 40, 49 and 50 also had poor workability due to excessiveness of the surface active layers and insufficiency of the lubricating particles.

TABLE 1

(Chromating Solution Applied Just After Bath Preparation)

| No. | Run | Type of Steel Sheet | Cr Deposit ($mg/m^2$) | $SiO_2$/Cr (weight ratio) | Type of Lubricating particles | Average size of lubricating particles | Lubricating particles/ Cr* | Surface coverage (%) | Press formability | Electric conductivity | Corrosion resistance | Remarks |
|---|---|---|---|---|---|---|---|---|---|---|---|---|
| 1 | Comp. Example | SECC | 6 | 2.0 | A | 8 μm | 20 | 5 | X | ◎ | X | Insufficient chromate |
| 2 | Comp. Example | SECC | 220 | 2.0 | A | 7 μm | 20 | 80 | X | X | ○ | Excessive chromate |
| 3 | Comp. Example | SECC | 50 | 0.07 | A | 8 μm | 20 | 30 | ○ | ○ | X | Insufficient silica |
| 4 | Comp. Example | SECC | 51 | 6.5 | A | 7 μm | 20 | 30 | ○ | X | ○ | Excessive silica |
| 5 | Comp. Example | SECC | 53 | 2.0 | A | 6 μm | 0.08 | <1 | X | ◎ | ○ | Insufficient lubricating particles |
| 6 | Comp. Example | SECC | 21 | 2.0 | A | 7 μm | 120 | 40 | ○ | X | ○ | Excessive lubricating particles |
| 7 | Example | SECC | 12 | 2.0 | B | 4 μm | 100 | 32 | ○ | ○ | | |
| 8 | Example | SECC | 20 | 0.1 | B | 6 μm | 50 | 30 | ○ | ○ | ○ | |
| 9 | Example | SECC | 54 | 0.5 | C | 8 μm | 10 | 15 | ○ | ○ | ○ | |
| 10 | Example | SECC | 106 | 1.0 | D | 7 μm | 1.0 | 5 | ○ | ◎ | ○ | |
| 11 | Example | SECC | 194 | 2.0 | E | 7 μm | 1 | 8 | ◎ | ◎ | ○ | |
| 12 | Example | SECC | 55 | 3.0 | F | 8 μm | 10 | 20 | ◎ | ◎ | ○ | |
| 13 | Example | SECC | 56 | 6.0 | A + B | 7 μm | 10 | 20 | ○ | ○ | ○ | |
| 14 | Example | SECC | 54 | 1.0 | A + C | 8 μm | 5 | 10 | ○ | ◎ | ○ | |
| 15 | Example | SECC | 50 | 1.0 | A + D | 8 μm | 5 | 10 | ○ | ◎ | ○ | |
| 16 | Example | SECC | 54 | 1.0 | A + E | 6 μm | 5 | 10 | ◎ | ◎ | ○ | |
| 17 | Example | SECC | 52 | 2.0 | A + F | 8 μm | 1 | 2 | ◎ | ◎ | ○ | |
| 18 | Example | SECC | 51 | 2.0 | A + B + E | 7 μm | 1 | 2 | ◎ | ◎ | ○ | |
| 19 | Example | SECC | 50 | 2.0 | A + B + F | 6 μm | 1 | 2 | ◎ | ◎ | ○ | |
| 20 | Comp. Example | SGCC | 31 | 0.06 | A | 4 μm | 20 | 25 | ○ | ○ | X | Insufficient silica |
| 21 | Comp. Example | SGCC | 30 | 6.3 | A | 5 μm | 20 | 25 | ○ | X | ○ | Excessive silica |
| 22 | Comp. Example | SGCC | 40 | 2.0 | E | 2 μm | 0.08 | <1 | X | ◎ | ○ | Insufficient lubricating particles |
| 23 | Comp. Example | SGCC | 32 | 2.0 | E | 0.9 μm | 110 | 70 | ◎ | X | ○ | Excessive lubricating particles |
| 24 | Example | SGCC | 42 | 2.0 | B | 6 μm | 10 | 16 | ○ | ○ | ○ | |
| 25 | Example | SGCC | 45 | 2.0 | F | 8 μm | 10 | 17 | ◎ | ◎ | ○ | |
| 26 | Example | SGCC | 40 | 2.0 | E | 1 μm | 10 | 15 | ◎ | ◎ | ○ | |
| 27 | Example | SGCC | 40 | 2.0 | C | 7 μm | 10 | 15 | ○ | ○ | ○ | |
| 28 | Comp. Example | SPCC | 7 | 1.5 | E | 7 μm | 10 | 3 | X | ◎ | X | Insufficient chromate |
| 29 | Comp. Example | SPCC | 213 | 1.5 | E | 1 μm | 5 | 48 | X | X | ○ | Excessive chromate |
| 30 | Example | SPCC | 63 | 1.5 | E | 1 μm | 5 | 13 | ◎ | ◎ | ○ | |
| 31 | Example | SPCC | 60 | 1.5 | A + E | 6 μm | 5 | 14 | ◎ | ◎ | ○ | |
| 32 | Example | SPCC | 61 | 1.5 | A + E | 5 μm | 5 | 15 | ◎ | ◎ | ○ | |
| 33 | Example | SPCC | 64 | 1.5 | A + E | 6 μm | 5 | 13 | ◎ | ◎ | ○ | |

*Weight ratio

TABLE 2

(Chromating Solution Applied 7 Days After Bath Preparation)

| No. | Run | Type of Steel Sheet | Type of Lubricating particles | Average size of lubricity imparted particles | Lubricating particles/Cr* | Type of surface layer | Proportion of lubricating component (%)** | Surface coverage (%) | Press formability | Electric conductivity | Corrosion resistance | Remarks |
|---|---|---|---|---|---|---|---|---|---|---|---|---|
| 34 | Comp. Example | SECC | E | 6 μm | 0.02 | none | 100 | <1 | X | ◎ | ○ | No surfactant |
| 35 | Comp. Example | SECC | E | 6 μm | 0.08 | W | 99.2 | <1 | X | ◎ | ○ | Insufficient surfactant |
| 36 | Comp. Example | SECC | E | 6 μm | 0.04 | V | 80 | <1 | X | ◎ | ○ | Anionic surfactant |
| 37 | Comp. Example | SECC | E | 6 μm | 0.04 | Z | 82 | <1 | X | ◎ | ○ | Cationic surfactant |
| 38 | Comp. Example | SECC | c | 3 μm | 0.04 | c | 82 | <1 | X | ◎ | ○ | Anionic emulsion |
| 39 | Comp. Example | SECC | E | 6 μm | 2 | W | 20 | 4 | X | ◎ | ○ | Excessive surfactant |
| 40 | Comp. Example | SECC | a | 3 μm | 0.04 | a | 29 | <1 | X | ◎ | ○ | Insufficient lubricating particles |
| 41 | Example | SECC | A + E | 8 μm | 2 | W | 82 | 4 | ◎ | ◎ | ○ | |
| 42 | Example | SECC | B | 7 μm | 1 | W | 85 | 2 | ○ | ◎ | ○ | |
| 43 | Example | SECC | C | 8 μm | 2 | X | 82 | 4 | ○ | ◎ | ○ | |
| 44 | Example | SECC | D | 7 μm | 1 | Y | 85 | 2 | ○ | ◎ | ○ | |
| 45 | Example | SECC | E | 7 μm | 1 | W | 98 | 2 | ◎ | ◎ | ○ | |
| 46 | Example | SECC | F | 1 μm | 1 | W | 30 | 3 | ◎ | ◎ | ○ | |
| 47 | Example | SECC | b | 2 μm | 1.5 | b | 86 | 4 | ◎ | ◎ | ○ | |
| 48 | Comp. Example | SGCC | c | 3 μm | 0.04 | c | 82 | <1 | X | ◎ | ○ | Anionic emulsion |
| 49 | Comp. Example | SGCC | E | 6 μm | 2 | W | 20 | 4 | X | ◎ | ○ | Excessive surfactant |
| 50 | Comp. Example | SGCC | a | 3 μm | 0.04 | a | 29 | <1 | X | ◎ | ○ | Insufficient lubricating particles |
| 51 | Example | SGCC | A + E | 8 μm | 2 | W | 82 | 4 | ◎ | ◎ | ○ | |
| 52 | Example | SGCC | B | 7 μm | 5 | W | 85 | 9 | ○ | ◎ | ○ | |
| 53 | Example | SGCC | C | 8 μm | 1 | W | 82 | 2 | ○ | ◎ | ○ | |
| 54 | Example | SGCC | F | 1 μm | 100 | W | 30 | 48 | ◎ | ○ | ○ | |
| 55 | Example | SGCC | b | 2 μm | 0.1 | b + W | 80 | <1 | ◎ | ◎ | ○ | |
| 56 | Comp. Example | SPCC | E | 6 μm | 0.03 | none | 100 | <1 | X | ◎ | ○ | No surfactant |
| 57 | Comp. Example | SPCC | E | 6 μm | 0.04 | W | 99.5 | <1 | X | ◎ | ○ | Insufficient surfactant |
| 58 | Comp. Example | SPCC | E | 6 μm | 0.03 | V | 82 | <1 | X | ◎ | ○ | Anionic surfactant |
| 59 | Example | SPCC | D | 7 μm | 3 | W | 85 | 7 | ○ | ◎ | ○ | |
| 60 | Example | SPCC | E | 7 μm | 2 | W | 80 | 5 | ◎ | ◎ | ○ | |
| 61 | Example | SPCC | F | 1 μm | 10 | W | 60 | 20 | ◎ | ○ | ○ | |
| 62 | Example | SPCC | b | 2 μm | 5 | b + W | 80 | 15 | ◎ | ◎ | ○ | |
| 63 | Example | 55% Al—Zn hot-dip plated steel sheet | b | 2 μm | 1 | b | 86 | 2 | ◎ | ◎ | ○ | |
| 64 | Example | 55% Al—Zn hot-dip plated steel sheet | F | 1 μm | 2 | W | 60 | 5 | ◎ | ◎ | ○ | |
| 65 | Example | A5182 Aluminum alloy sheet | b | 2 μm | 0.5 | b | 86 | 1 | ◎ | ◎ | ○ | |
| 66 | Example | A5182 Aluminum alloy sheet | D | 7 μm | 1.2 | W | 85 | 3 | ◎ | ◎ | ○ | |

*Weight ratio
**Proportion (wt %) of lubricating particles in the lubricity imparted particles According to the present invention, one or more kinds of lubricating particles as selected from among graphite, $MoS_2$, BN, calcium stearate and an organic lubricating substance, or one or more kinds of these lubricating particles as treated with nonionic surfactants are added in appropriate amounts to a $SiO_2$ containing chromate film on metal substrates and this enables the production of metal sheets that can be press formed without being coated with a lube oil, that have high corrosion, and that have a surface resistivity of no more than 0.5Ω.

What is claimed is:

1. A chromated metal sheet that has high corrosion resistance along with improved lubricity and electrical conductivity, comprising: a chromate layer on at least one surface of a metal substrate or a plated metal substrate, wherein said chromate layer has a chromium deposit in the range of 10–200 mg/m$^2$ per surface in terms of metallic Cr, wherein said chromate layer contains silica in a weight ratio of 0.1–6.0 of $SiO_2$ to Cr and lubricating particles selected from the group consisting of graphite, $MoS_2$, BN, calcium stearate and an organic lubricating substance, said lubricating particles being present in a weight ratio of 0.1–100 of the lubricating particles to Cr, and wherein the coverage of the surface of said metal substrate with said lubricating particles is less than 50%.

2. A chromated metal sheet according to claim 1 wherein the organic lubricating substance comprises particles selected from the group consisting of natural waxes, polyolefin waxes, modified polyolefin waxes and fluorocarbons.

3. A chromated metal sheet according to either of claims 1 or 2 wherein said metal substrate is a steel sheet.

4. A chromated metal sheet according to either of claims 1 or 2 wherein said plated metal substrate is an electrogalvanized steel sheet or a hot-dip galvanized steel sheet.

5. A chromate metal sheet according to claim 1, wherein said lubricating particles have an average particle size of less than 20 μm.

6. A chromate metal sheet according to claim 1, wherein said improved electrical conductivity is equivalent to surface electric resistivities of less than 0.5Ω.

7. A chromate metal sheet according to claim 1, wherein said chromate metal sheet is capable of withstanding press forming in the absence of lube oil coating.

8. A chromate metal sheet according to claim 1, wherein said chromate metal sheet is capable of being used for parts for home electrical appliances.

9. A chromate metal sheet according to claim 1, wherein said lubricating particles have a surface layer capable of nonionic surface activating action formed on the lubricating particle, said surface layer capable of nonionic surface activating action being about 1%–70% by weight of said lubricating particle, said lubricating particles as calculated in terms of the lubricating particle being present in a weight ratio of 0.1–100 to Cr.

10. A chromated metal sheet possessing the combined properties of high corrosion resistance, improved lubricity and improved electrical conductivity, comprising:

a metal substrate, a chromate layer adhered to said metal substrate, said chromate layer comprising a chromium deposit in the range of 10–200 mg/m$^2$ expressed as metallic Cr, a plurality of silica particles dispersed throughout said chromate layer in a weight ratio of 0.1–6.0 parts by weight of $SiO_2$ per unit weight of Cr;

a plurality of lubricating particles dispersed throughout said chromate layer, said lubricating particles being selected from the group consisting of graphite, $MoS_2$, BN, calcium stearate and an organic lubricating substance, said lubricating particles being present in a weight ratio of 0.1–100 per unit weight of Cr, wherein said lubricating particles are dispersed on the surface of said metal substrate with a coverage of less than 50%; and wherein said lubricating particles have a surface layer nonionic surfactant positioned on each of said lubricating particles, said surfactant having nonionic surface activating action and being present in an amount of about 1%–70% by weight of the weight of said lubricating particles, said lubricating particles being present in a weight ratio of 0.1–100 to the weight of Cr.

11. The chromated metal sheet defined in claim 10, wherein the said chromium in said chromate layer is predominately trivalent chromium, and wherein at least 70 wt % of the total Cr content of said chromate layer is insoluble in an aqueous alkaline solution.

12. A chromated metal sheet according to claim 10, wherein the organic lubricating substance comprises lubricating particles selected from the group consisting of natural waxes, polyolefin waxes, modified polyolefin waxes and fluorocarbons.

13. A chromated metal sheet according to claim 10, wherein said metal substrate is a steel sheet.

14. A chromated metal sheet according to claim 10, wherein said metal substrate is plated and selected from the group consisting of an electrogalvanized steel sheet and a hot-dip galvanized steel sheet.

15. A chromated metal sheet according to claim 10, wherein said metal substrate is plated and selected from the group consisting of an aluminum plated steel sheet and an aluminum alloy plated steel sheet.

16. A chromated metal sheet according to claim 10, wherein said metal substrate is selected from the group consisting of an aluminum sheet and an aluminum alloy sheet.

* * * * *

UNITED STATES PATENT AND TRADEMARK OFFICE

CERTIFICATE OF CORRECTION

PATENT NO. : 5,700,561

DATED : December 23, 1997

INVENTOR(S) : Junichi Mano, et al

It is certified that error appears in the above-indentified patent and that said Letters Patent is hereby corrected as shown below:

In column 6, at lines 18 and 19, please change "($C_XH_{2X+1}$, X=1-20)); preferably, R=$C_9H_{19}$ or $C_8H_{17}$" to --($C_XH_{2X+1}$, X=1-20); preferably, R=$C_9H_{19}$ or $C_8H_{17}$)--.

Signed and Sealed this

Twenty-fourth Day of February, 1998

*Attest:*

*Attesting Officer*

BRUCE LEHMAN

*Commissioner of Patents and Trademarks*